United States Patent [19]

Schuster et al.

[11] Patent Number: 4,639,155

[45] Date of Patent: Jan. 27, 1987

[54] MELT DISPENSERS

[75] Inventors: Heinz Schuster, Oberursel; Gerd Press, Kelkheim/TS, both of Fed. Rep. of Germany

[73] Assignee: USM Corporation, Flemington, N.J.

[21] Appl. No.: 767,275

[22] PCT Filed: Dec. 18, 1984

[86] PCT No.: PCT/GB84/00438

§ 371 Date: Aug. 2, 1985

§ 102(e) Date: Aug. 2, 1985

[87] PCT Pub. No.: WO85/02793

PCT Pub. Date: Jul. 4, 1985

[30] Foreign Application Priority Data

Dec. 22, 1983 [GB] United Kingdom ..... 8334298
Oct. 26, 1984 [GB] United Kingdom ..... 8427170

[51] Int. Cl.[4] ..... B67D 5/32

[52] U.S. Cl. ..... 401/1; 401/2; 222/146.1; 222/146.2

[58] Field of Search ..... 401/1, 2, 81, 180; 222/146.1, 146.5; 219/230

[56] References Cited

U.S. PATENT DOCUMENTS 3,743,142 7/1973 Elliott et al. ..... 222/146.5
4,032,046 6/1977 Elliott et al. ..... 401/2
4,378,076 3/1983 Stirnweiss ..... 222/146.5

FOREIGN PATENT DOCUMENTS 0030893 6/1981 European Pat. Off. .
2033018 5/1980 United Kingdom ..... 401/2
1582488 1/1981 United Kingdom .

*Primary Examiner*—Richard J. Apley
*Attorney, Agent, or Firm*—Thomas S. Szatkowski

[57] ABSTRACT

A device for use in a hand held hot melt gun to prevent drool of melted composition from the outlet thereof when the gun is not in use is described and claimed. In one embodiment of the invention the device comprises a melt body 10 having a melt chamber 12, resilient means provided by a coil spring 26 and means 36 for heating the melt body. When in use a rod of composition urged by a feeding force in a direction towards the melt body 10 is melted in the melt chamber 12 and is dispensed in molten condition from the outlet 20. When the feeding force is released after use the spring exerts sufficient force in a reverse direction to the direction of the feeding force to move the rod outwardly of the melt body, which relieves the pressure within the melt body and thereby substantially prevents further composition from drooling from the outlet.

16 Claims, 6 Drawing Figures

MELT DISPENSERS

TECHNICAL FIELD

This invention relates to melt dispensers.

Various proposals have been made to provide apparatus for melting and dispensing thermoplastic material supplied in the form of a rod. Such apparatus is usually provided with a melt body having a melt chamber in which thermoplastic material is melted, an inlet for the rod and an outlet comprising an orifice for dispensing melted material, and means for heating the melt body so that composition fed as a rod into the melt chamber may be dispensed in molten condition from the orifice. Such apparatus finds use in various fields of application, an important example being hand held glue guns having provision for feeding a rod of adhesive to the melt body for example by direct thumb pressure or by trigger operated means.

BACKGROUND ART

A persistent problem associated with hot melt dispensers which rely on feeding of the rod to cause outflow of molten composition from the orifice is the drooling of cement from the orifice which tends to occur when feeding of the rod ceases and the melt body remains hot. This drooling is wasteful, inconvenient and messy. While the employment of check valves has assisted in reducing drool, it remains highly desirable to provide an inexpensive means for further reducing or eliminating drool. Proposals have been made to physically pull the rod of adhesive out of the melt body to a limited extent, but such proposals require complications in the mechanism of the apparatus with consequent increase in its weight and/or cost and furthermore such proposals are ineffective when there is a discontinuity in the rod between the pulling mechanism and the melt chamber, as may occur for example when the rod is made up of short sticks of adhesive held together merely by pressure exerted to feed the rod, as is the case particularly for example in the case of glue guns normally used by "do it yourself" enthusiasts.

It is one of the various objects of the present invention to provide an improved device for melting and dispensing thermoplastic material supplied in the form of a rod.

DISCLOSURE OF INVENTION

The invention provides as one of its aspects a device for melting and dispensing thermoplastic material supplied in the form of a rod comprising a melt body having an inlet end and an outlet end and a melt chamber within the melt body, the inlet end being adapted to receive a solid rod of composition as it is fed to the melt chamber, and the outlet end having an orifice, means for heating the melt body so that composition fed into the melt chamber via the inlet end in the form of a rod may be dispensed in molten condition from the orifice in response to application of a feeding force on the rod to urge it in a direction towards the melt body, and resilient means located within the melt body arranged to exert sufficient force in a reverse direction to move the rod outwardly of the melt body when the feeding force is not applied.

In a device according to the invention, the resilient means is preferably provided by a coil spring trapped in the melt body and arranged to act directly or indirectly upon a solid portion of a rod fed into the melt chamber.

As a first embodiment of the invention hereinafter described, the coil spring is arranged to bear directly on the advancing solid end of the rod. As a second embodiment of the invention, the coil spring is arranged to bear upon a melt chamber element which is slidable in the melt body, whereby to move the melt chamber element and the advancing solid end of the rod entering the melt chamber outwardly of the melt body when the feeding force is not applied.

Preferably the spring does not reduce the melting capacity of the melt body and thus, the spring preferably is in heat conductive contact with the melt body, so that it may be heated by transfer of heat from the melt body, and so contribute to melting of the thermoplastic material.

In a simple form of the invention, for example the first embodiment hereinafter described, preferably a coil of the spring furthermost from the inlet end is located in a recess in the melt body, and is in good heat conductive contact with the melt body. Preferably an end portion of the spring near to the inlet end is formed to provide a portion extending across the end of the spring. Preferably the spring is of a size and strength that its outer surfaces are in close proximity to walls of the chamber, that it is not distorted to interfere significantly with passage of melted thermoplastic material through the melt chamber during feeding a rod, and that it may move a rod outwardly of the melt body when feeding pressure is removed, and yet is not so strong as to eject the rod entirely from the melt body.

In a more sophisticated form of the invention, for example the second embodiment hereinafter described, the spring is preferably arranged so that it is of a size and strength that its outer surfaces are in close proximity to walls of the melt body, that it is not distorted to interfere significantly with passage of melted thermoplastic material through the melt chamber during feeding a rod and that it may move the melt chamber element and rod outwardly of the melt body when feeding pressure is removed.

In both forms of the invention desirably the spring when relaxed i.e. when the feeding force is not applied, is of a size sufficient to relieve the pressure of composition within the melt body which urges further composition out through the orifice, thereby substantially preventing the drool of melted composition from the orifice, but does not move the rod so far outwardly of the melt body that air will be drawn into the melt body through the orifice.

Preferably the coil spring used in a device according to the invention is of a wire material that is not deleteriously affected by the environment within the melt body which may be maintained at temperatures of the order of 230° C. or even higher, and which under extreme conditions may also contain decomposition products of the rod. The characteristics desired of the spring may differ according to the composition of the rod, for example, where a rod having a smooth surface is employed, the frictional force between the rod and lip means (hereinafter described) will be less than for a rod having a rough surface, hence the spring will have to exert a lesser force to urge a smooth rod outwardly of the melt body as for a rod having a rough surface. We have found coil springs formed from 2 mm diameter wire of a stainless steel alloy according to German standard 1.4310, UK B.S. 304 S 62 or USA A1A1 301 comprising about eight turns and having an overall spring length of about 5 cm, which have been subjected to an additional heat treatment of 300° C., to be most suitable for use in a cylindrical portion of a melt body which cylindrical portion has a length of 5.6 cm and a diameter of 1.9 cm.

A device according to the invention preferably comprises an inlet sleeve of resilient material through which a rod may be introduced to the melt chamber. Preferably the resilient sleeve is provided with lip means which clasp a rod fed to the melt chamber to minimise back flow of melted composition along the rod. Conveniently in a simpler form of device according to the invention, the lip means may be of a size to ensure that the resilient rod returning means does not accidentally become removed from the melt chamber.

In another of its aspects the invention provides a device for melting and dispensing thermoplastic material supplied in the form of a rod comprising a melt body having an inlet end and an outlet end, a passage extending between the inlet end and the outlet end and means for mounting a nozzle assembly at the outlet end wherein the passage is adapted to receive a melt chamber element in such a way that the melt chamber element may be caused to slide within the melt body and may be heated from the melt body to an extent sufficient to melt thermoplastic material fed to the melt chamber. In such a device the nozzle assembly may be releasably mounted at the outlet end so that the melt chamber element may be removed from the melt body when the nozzle assembly is released from the melt body.

In a device according to the invention, the melt chamber may be of any desired form or configuration so that it may be adapted to receive a rod of any shape for example a rod having a circular, rectangular or triangular section. As the first embodiment of the invention hereinafter described to illustrate the invention by way of example the melt chamber is provided by a passage in the melt body shaped to define a conical surface tapering from a cylindrical surface shaped to accept a rod of composition fed thereto. As the second embodiment of the invention hereinafter described to illustrate the invention by way of example the melt body has a passage extending between its inlet end and outlet end which is adapted to receive a melt chamber element in such a way that the melt chamber element may be caused to slide within the melt body and may be heated from the melt body to an extent sufficient to melt thermoplastic material fed to the melt chamber. The melt chamber is provided in the melt chamber element, and has an inlet through which a rod of composition may be inserted into the chamber and an outlet from which melted composition may be dispensed and fin elements disposed lengthwise within the chamber progressively increasing in size considered in a direction extending from the inlet to the outlet, so shaped and located that edge surfaces thereof disposed towards an interior of the chamber define surface portions of an opening of progressively reducing cross section, the peak of which opening is located adjacent the outlet but on the inlet side thereof and so that end portions of the fin elements at the outlet are spaced to define a series of exit slots spaced about an axis of the opening to provide the outlet. At least one housing is provided in the melt body for receiving electrically operated heating means for heating the melt body. A melt chamber of such configuration is described and claimed in UK patent application No. 8419303.

In a device according to the invention the orifice is preferably shaped to provide a dispensing nozzle or to communicate with a nozzle assembly adapted to be secured to the melt body. Preferably a ball valve is provided to assist in controlling flow of composition from the orifice.

In a device according to the invention the means for heating the melt body may be provided in any convenient form. We prefer to employ one or more electrical heaters of the PTC type.

A device according to the invention may be used for dispensing various materials including adhesives and sealants supplied in cylindrical stick or rod form, and may be incorporated in apparatus appropriate to the intended purpose. Preferably a device according to the invention is incorporated in a hand held glue gun, which may be arranged so that thermoplastic rod is fed to the melt body under direct thumb pressure from the hand of an operator of the gun, or more preferably is arranged so that thermoplastic rod is fed to the melt chamber by a mechanism actuated by a trigger of the gun for example as shown in registered designs Nos. 1009681 or 1009682 or as described in German patent application No. 33 20 041.

By use of a device according to the invention, in which resilient means for moving a rod outwardly of the melt body when the feeding force is not applied is housed entirely within the melt body, unwanted drool is at least substantially eliminated. Also it is possible to provide return control of the rod and therefore of pressure of melt within the melt body even when only a small amount of rod remains to be fed. This is an important feature where the rod is provided by a series of short glue sticks fed end to end, as regularly happens in the field of glue guns and particularly in so called D.I.Y. activities. Furthermore by selection of an appropriate coil spring, the device remains comparatively inexpensive and uncomplicated. By use of an arrangement in which the resilient means is arranged to bear upon the melt chamber element to urge it towards the inlet end, thus to move the melt chamber element and rod outwardly of the melt body one may also realize the additional advantage that the resilient means is conveniently trapped within the melt body and is unlikely to be removed when unwanted unmelted rod is pulled from the inlet end of the melt body.

In order that the invention may become more clear, there now follows a detailed description to be read with the accompanying drawings of two example devices according to the invention and illustrative thereof. It is to be understood that the illustrative devices have been selected for description to illustrate the invention by way of example and not by way of limitation thereof.

MODES FOR CARRYING OUT THE INVENTION

Figure 1:
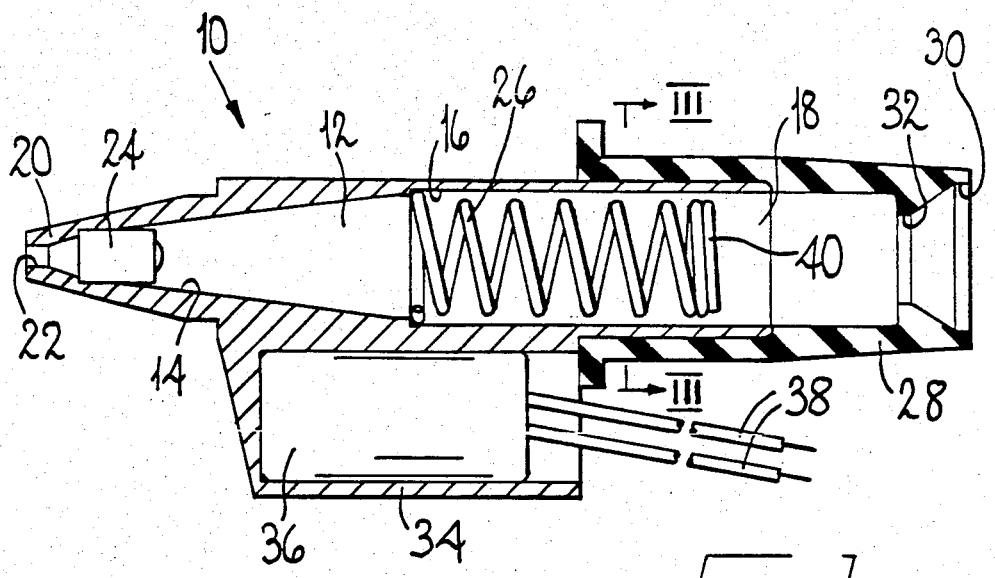
FIG. 1 is a sectional view of the first illustrative device.

The illustrative devices each provide a device for melting and dispensing thermoplastic material supplied in the form of a rod comprising a melt body having an inlet end and an outlet end and a melt chamber within the melt body, the inlet end being adapted to receive a solid rod of composition as it is fed to the melt chamber, and the outlet end having an orifice, means for heating the melt body so that composition fed into the melt chamber via the inlet end in the form of a rod may be dispensed in molten condition from the orifice in response to application of a feeding force on the rod to urge it in a direction towards the melt body, and resilient means located within the melt body arranged to exert sufficient force in a reverse direction to move the rod outwardly of the melt body when the feeding force is not applied.

In the first illustrative device, the melt body 10 comprises a casting of a heat conductive alloy formed with a passage to provide a melt chamber 12, defined by a conical surface 14 tapering from an adjacent cylindrical surface 16. The melt body has an inlet end 18 of substantially cylindrical section at one end of the cylindrical surface 16, and an outlet end 20 at a narrowed end of the conical surface 14, having an orifice 22. A spring loaded ball valve 24 is located within the melt chamber adjacent the outlet end 20. Resilient means in the form of a coil spring 26 is housed in the melt chamber, with its leading coil held in a recess in the melt body between the cylindrical and conical surfaces in heat conductive manner.

A flexible moulded silicone rubber inlet sleeve 28 is secured on the melt body over the inlet end by spring means (not shown) with a cylindrical inner surface of the sleeve providing an extension of the cylindrical surface 16 of the melt chamber. The sleeve is provided with an inlet opening 30 of sufficient size to locate and guide a rod of composition which is to be fed to the melt chamber 12. Lip means 32 is provided on the interior of the sleeve adjacent the inlet opening 30, which are so shaped and positioned as to exert a gripping action on composition fed through the inlet opening in the form of a rod of a diameter not substantially less than the diameter of the cylindrical surface 16 of the melt chamber.

The melt body is provided with a housing 34 for means for heating the melt body which means comprises an electrically operated heating element 36 for example provided by a PTC heater connected to a source of electricity via leads 38 and arranged to heat the melt body so as to melt fusible composition in the melt chamber.

Figure 2:
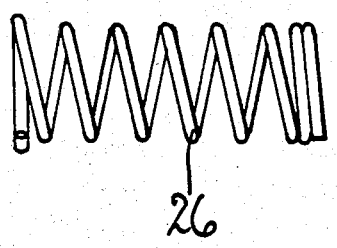
FIG. 2 is a view of a spring shown in FIG. 1.
Figure 3:
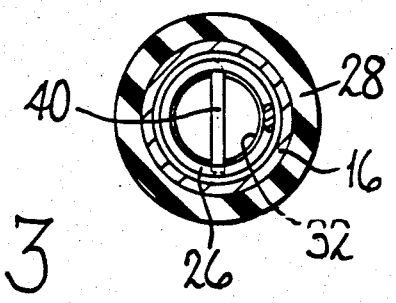
FIG. 3 is a sectional view taken substantially on the line III—III of FIG. 1 viewed in the direction of the arrows.

The spring 26 comprises a coil of eight turns of stainless steel wire of 2 mm diameter according to German standard No. 1.4310 and subjected in course of its manufacture to an additional heat treatment at 300° C. The spring terminates at its right hand end as viewed in FIGS. 1 and 2, in a final turn bent to provide a straight portion 40 which extends across the diameter of the spring to the opposite side of the coil (see FIG. 3). The spring is of a diameter sufficient to enable the spring to be compressed and allowed to expand within the melt chamber axially of the spring adjacent the cylindrical surface 16. The diameter of the first turn of the spring is also larger than the diameter of a circular opening to the conical surface 14 from the cylindrical surface 16. The diameter of the remainder of the spring is larger than the opening described by the lip means 32. As shown in FIG. 1, prior to compression the spring 26 extends rearwardly in the melt chamber to an extent such that an end portion of a solid rod may be introduced through the inlet end 18 to the melt chamber. The spring is sufficiently robust that during feeding of rod into the melt chamber the spring is not significantly distorted radially of the spring, and sufficiently strong to gently urge a rod rearwardly of the melt chamber when compressive forces on the spring are released to move the rod outwardly of the melt body.

The illustrative device is intended to be incorporated in apparatus for melting and dispensing thermoplastic material, for example a hand held glue gun, having provision for feeding a rod of adhesive composition to the apparatus for example by direct thumb pressure or by trigger operated means. When a rod of adhesive is to be fed into the device; with the heater operating, an end portion of the rod is introduced to the inlet opening 30 and through the lip means 32 causing the sleeve to be distended to accommodate the rod. Further pressure on the rod to exert a feed force on the rod urges it to move through the lip means, towards the orifice, and into the cylindrical portion of the melt chamber. A leading end portion of the rod engages the straight portion 40 of the spring and the end coil of the spring, and the spring is compressed. As a result of transfer of heat from the melt body and spring to the leading end portion of the rod, the rod is melted and subsequent portions of the rod are fed into the melt chamber, with a solid leading portion of unmelted rod in engagement with the spring. Continued exertion of feeding pressure on the rod maintains compressive force on the spring and exerts pressure on the melted material in the melt chamber so to cause flow of melted material from the orifice 22 via the ball valve 24. When the feeding pressure is removed from the rod, pressure on the melt is relieved and flow of melted material from the orifice ceases. Also, the spring exerts sufficient force on the rod to urge the rod outwardly of the melt chamber, and to move the rod a short distance outwardly through the lip means. In this way, pressure built up in the melt chamber is further relieved.

In the second illustrative device, the melt body 110 comprises a casting of a heat conductive alloy formed with a passage 112 defined by a cylindrical surface. The melt body has an inlet end 118 of substantially cylindrical section at one end of the cylindrical passage 112, and a circular outlet end 120 at the other end of the passage 112. The passage 112 extending between the inlet end and outlet end of the melt body is adapted to receive a melt chamber element 116 in such a way that the melt chamber element may be caused to slide within the melt body and may be heated from the melt body to an extent sufficient to melt thermoplastic material fed to the melt chamber. The melt chamber is provided in the melt chamber element, and has an inlet 117 through which a rod of composition may be fed into the melt chamber and an outlet 119 from which melted composition may pass to the outlet end 120 of the melt body. A nozzle assembly 122 including a spring loaded ball valve is threadably secured at the outlet end 120 of the melt body. Resilient means in the form of a coil spring 126 is housed in the melt body, with its leading coil held in contact with an annular surface of the nozzle assembly and its trailing coil in contact with an end surface of the melt chamber element.

The inlet end 118 of the melt body and the inlet 117 of the melt chamber element are formed to accept rods of thermoplastic material of circular section. The passage 112 is of larger diameter than the inlet end 118 to an extent sufficient to slidably receive the melt chamber element so that contiguous surfaces of the melt chamber element and melt body surfaces are in heat conductive contact and so that the inlet end 118 and inlet 117 are in register. A shoulder 121 is thus provided between the passage and inlet end which serves to limit rearward movement of the melt chamber element in the melt body.

Fin elements 123 are disposed lengthwise within the chamber element 116, the fin elements 123 protrude from a wall surface of the chamber into the melt chamber and extend parallel to the axis of the melt chamber and increase in size towards the outlet. The fin elements comprise major fin elements 127 and sub elements, each of which fin elements has a plate like structure having a substantially triangular configuration. The major elements 127 are arranged as a tripod within the melt chamber which is effective at least towards the outlet 119 of the melt chamber to separate the melt chamber into three sub-chambers and so that inner edge surfaces of the major elements provide surface portions of a substantially pyramid shaped opening 131 centrally disposed in the chamber and which narrows to a peak located adjacent the outlet 119. The sub elements are disposed between adjacent major elements.

Figure 4:
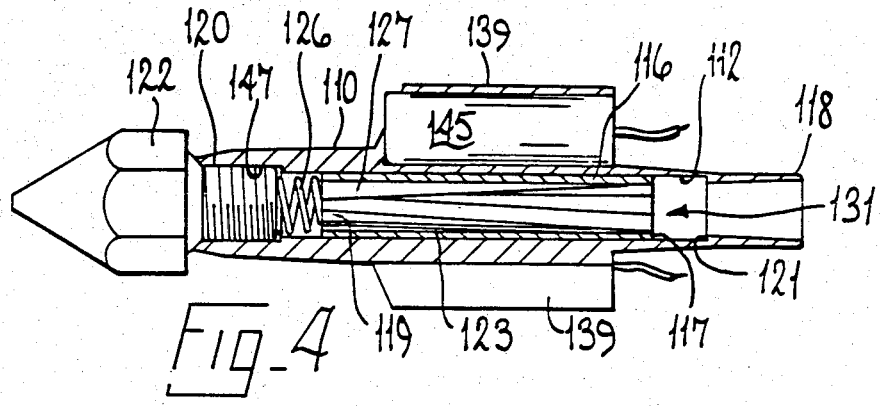
FIG. 4 is a sectional view of the second illustrative device showing parts in positions assumed during feeding of a rod.
Figure 5:
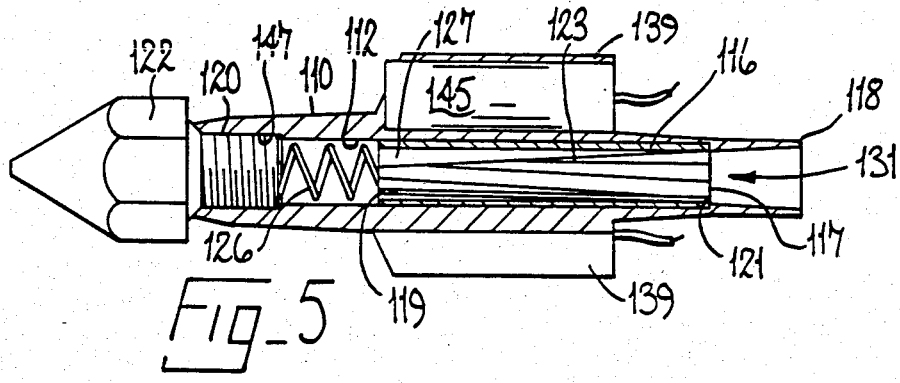
FIG. 5 is a sectional view of the second illustrative device showing parts in positions assumed prior to feeding of a rod.

The spring 126 comprises a coil of 8 turns of stainless steel wire of 2 mm diameter according to German standard No. 1.4310 and subjected in course of its manufacture to an additional heat treatment at 300° C. The spring is of a diameter sufficient to enable the spring to be compressed and allowed to expand within the melt body axially of the spring adjacent the cylindrical passage 112. The diameter of the spring is similar to that of the melt chamber element. As shown in FIG. 5, prior to compression of the spring 126, the melt chamber element 116 occupies a rearward position in the melt body in which the melt chamber element abuts the shoulder 121, and is located so that an end portion of a solid rod may be fed via the inlet end 118 to the inlet 117. During feeding of rod into the melt chamber the spring 126 is compressed but not significantly distorted radially so that the spring and melt chamber assume positions as shown in FIG. 4, i.e. the melt chamber element is caused by feeding pressure on the rod acting on the fins in the melt chamber to move forwardly in the melt body to an extent permitted by the spring. The spring is sufficiently strong to urge the melt chamber element 116 rearwardly of the melt body towards the inlet end and thus to move the rod outwardly of the melt body when compressive forces on the spring are released.

The melt body comprises three housings 139 each having a bore having an axis parallel to the axis of the passage 112 for receiving electrically operated heating means in the form of cylindrical self regulating heaters 145 comprising PTC resistors distributed about the chamber. The heaters 145 are of a kind substantially as described in GB Patent Specification No. 1540482 and are constructed and arranged so that the melt body may be heated to a maximum temperature of about 225° C. Suitable uniform distribution of the heaters is achieved in the melt body shown together with desirable slim characteristics of the melt body. Webs 141 and 143 formed between pairs of the housings serve to strengthen the melt body. Locating bosses 155 (FIG. 6) are formed on the melt body in order to co-operate with sockets formed in the body parts of a glue gun in which the melt body is to be mounted.

The melt body has a threaded bore 147 coaxial with the melt chamber into which the nozzle assembly 122 is threaded. This arrangement allows the nozzle assembly 122 to be removed after use for replacement of the melt chamber element or nozzle or cleaning of the melt chamber element and or passageway 112. This proves advantageous if it is desired to use a second rod of different composition to that of a first rod previously used in the melt body for example having a different softening point. In such a case the melt chamber element which contained the first rod may be removed from the melt body 110 through the outlet end 120 of the melt body, and another melt chamber element arranged to receive the second rod inserted into the passageway 112 through the outlet end 120. The nozzle assembly 122 may then be rethreaded into the threaded bore 147 of the melt body.

Figure 6:
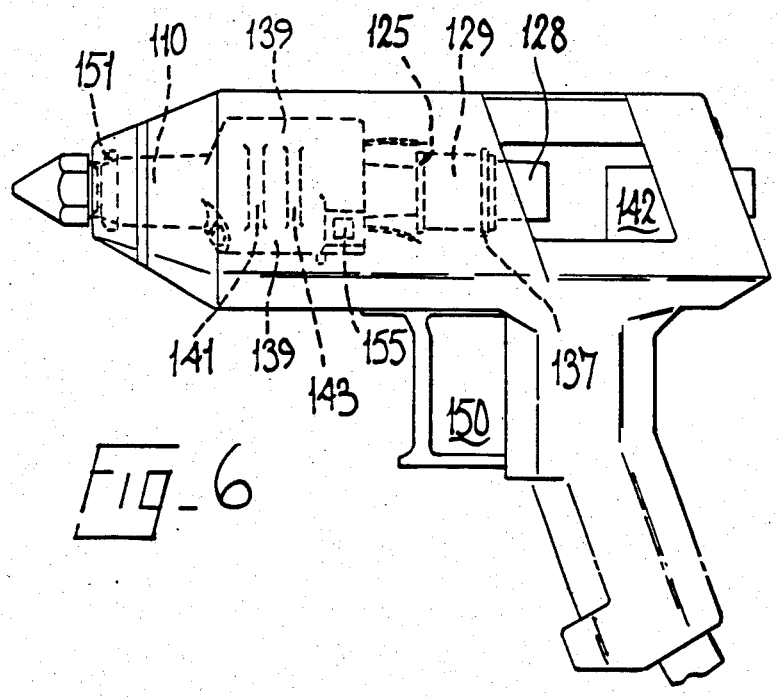
FIG. 6 is a side view of a hot melt hand held gun incorporating the second illustrative device.

An outer surface of the inlet end 118 of the melt body is formed to provide a tube onto which a flexible inlet tube 128 of silicone rubber is secured (FIG. 6). The inlet tube 128 is formed from resilient heat resistant material and has a flange 125 at its forward end and is maintained in place on the tube by a bell shaped sleeve 129. The inlet tube 128 has an inlet passage coaxial with the melt chamber in the melt body through which a rod of hot melt material, for example an adhesive or sealant, may be introduced into the inlet end of the melt body and hence to the inlet of the melt chamber. The inlet tube 128 is of circular cross section and is formed with an inner lip portion, not shown, so that as well as exerting a gripping action on the rod through the inlet opening and guiding the rod of hot melt into the melt chamber, the tube forms a seal with the surface of the rod, militating against escape of molten hot melt material from the inlet when the rod is fed into the chamber.

The second illustrative device is intended to be incorporated in apparatus for melting and dispensing thermoplastic material, for example a hot melt hand held glue gun as shown in FIG. 6.

In the glue gun shown in FIG. 6, the second illustrative device is mounted in body portions of the gun. A locating ring 151 of resilient heat resistant material encircles a forward portion of the melt body adjacent the nozzle and is received in co-operating recesses formed in the gun body portions. The sleeve 129 is formed with a locating ring 137 which is received in co-operating grooves formed in the gun body portions. The melt body is thus mounted in the body portions at its outlet and inlet ends by means of the rings 151 and 137 and at a mid portion by means of the bosses 155.

The parts of the gun body are moulded of tough plastics material and are secured together by fastenings including screws (not shown).

The glue gun is provided with trigger operated feeding means comprising clamping means comprising a carriage 142, mounted for sliding movement towards and away from the melt body 110 and a clamp member not shown, pivotally mounted on the carriage 142, and a trigger 150 for actuating the clamp member.

The carriage 142 comprises an upstanding part having a guide aperture through which the rod passes, with a small clearance, as it is fed to the melt body. When a rod of adhesive is to be fed into the glue gun shown in FIG. 6, with the heater operating, an end portion of the rod is introduced to the carriage 142 and through the inlet passage of the inlet tube 128, causing the sleeve to be distended to accommodate the rod. Further pressure on the rod by operation of the trigger operated feeding means exerts a feed force on the rod and urges it to move through the lip means of the inlet tube, towards the melt body, and into the inlet end 118 and into the inlet 117 of the melt chamber element. A leading end portion of the rod engages the fin elements within the melt chamber, and the spring is compressed. As a result of transfer of heat from the melt body to the fin elements of the melt chamber and to the leading end portion of the rod, the rod is melted and subsequent portions of the rod are fed into the melt chamber. Continued exertion of feeding pressure on the rod causes the solid regions of the rod to not only maintain compressive force of the melt chamber element on the spring but also exert pressure on the melted material in the melt chamber so to cause flow of melted material from the outlet 119 of the melt chamber element, through the portion of the passage containing the spring and out of the nozzle assembly. When the feeding pressure is removed from the rod, forward pressure on the melt is relieved and flow of melted material from the nozzle assembly ceases. Also, the spring exerts sufficient force on the melt chamber element to urge the rod outwardly of the inlet end of the melt body and to move the rod a short distance outwardly through the inlet end and the inlet tube 128. In this way pressure built up in the melt chamber is further relieved.

We claim:

1. In a device for melting and dispensing thermoplastic material supplied in the form of a rod, said device comprising means for application of a feeding force on the rod to urge it in a direction towards a melt body and a melt body having an inlet adapted to receive a rod of thermoplastic material, an outlet, a passage extending between the inlet and outlet, and means for heating the melt body so that material which enters the passage via the inlet in the form of a rod may be dispersed from the outlet in a molten condition;

wherein the improvement comprises resilient means located within the passage and arranged to exert sufficient force in a reverse direction to move the rod outwardly of the melt body when the feeding force is not applied.

2. A device according to claim 1 wherein the resilient means comprises a coil spring.

3. A device according to claim 2 wherein said coil spring is in heat conductive contact with the melt body whereby it contributes to melting of the thermoplastic material.

4. A device according to claim 1 wherein said outlet comprises an orifice.

5. A device according to claim 1 wherein said resilient means is arranged to engage the solid portion of a rod fed into the melt chamber.

6. A device according to claim 2 wherein the device further comprises an inlet sleeve for guiding a rod to the inlet of the melt body, the sleeve having lip means for gripping engagement with the rod.

7. A device according to claim 6 wherein the diameter of the coil spring is larger than that of an opening described by the lip means.

8. A device according to claim 1 wherein a melt chamber is provided by a melt chamber element which is movable with the passage in the melt body and the resilient means is arranged to engage the melt chamber element to move it in a direction outwardly of the melt body when the feeding force is not applied.

9. A device according to claim 8 wherein the passage in the melt body is provided with a stop means whereby movement of the melt chamber element towards the inlet end is limited.

10. A device according to claim 8 wherein said outlet comprises a nozzle assembly.

11. A device according to claim 10 wherein the resilient means is located within the passage between the outlet nozzle assembly and the melt chamber element.

12. A hot melt hand held glue gun which comprises a device according to claim 1, 2, 5 or 6.

13. A hot melt hand held glue gun which comprises a device according to claim 1, 8 or 9.

14. A device according to claim 8 further comprising trigger operated means for feeding the rod into the melt chamber.

15. A device according to claim 10 wherein said nozzle assembly is releasably mounted and that the melt chamber element may be removed from the melt body when the nozzle assembly is released from the melt body.

16. A device according to claim 4 wherein said outlet comprises a nozzle assembly.

* * * * *